United States Patent [19]

Depka

[11] 4,091,587

[45] May 30, 1978

[54] CEMENT BLOCK WALL

[76] Inventor: Charles W. Depka, 4885 Hillside Dr., Carlsbad, Calif. 92008

[21] Appl. No.: 768,205

[22] Filed: Feb. 14, 1977

[51] Int. Cl.[2] ..... E04B 2/44

[52] U.S. Cl. ..... 52/421; 52/561; 52/439

[58] Field of Search ..... 52/439, 566, 567, 747, 52/415, 421, 605, 426, 427, 284, 286, 566, 567, 271, 564, 585, 438; 264/31, 35

[56] References Cited

U.S. PATENT DOCUMENTS

| | | | |
|---|---|---|---|
| 1,630,698 | 5/1927 | Florey | 52/606 |
| 2,241,169 | 5/1941 | Yokes | 52/593 |
| 3,255,562 | 6/1966 | Altschuler | 52/427 |
| 3,325,956 | 6/1967 | Moraetes | 52/585 |
| 3,902,296 | 9/1975 | Thomas | 52/747 |

FOREIGN PATENT DOCUMENTS

| | | | |
|---|---|---|---|
| 178,178 | 8/1953 | Austria | 52/421 |
| 591,067 | 8/1947 | United Kingdom | 52/286 |

*Primary Examiner*—James L. Ridgill, Jr.
*Attorney, Agent, or Firm*—Duane C. Bowen

[57] ABSTRACT

Method and means for constructing a cement block wall without mortar in which standard blocks can be used. Interengaging means, having rectangular flanges, engage cells of upper course blocks and cells of lower course blocks therebelow. Blocks can be abutted or separated by interposed members made of plastic or the like that extend to edges and have the appearance of mortar points, which are integrated with said interengaging means.

24 Claims, 27 Drawing Figures

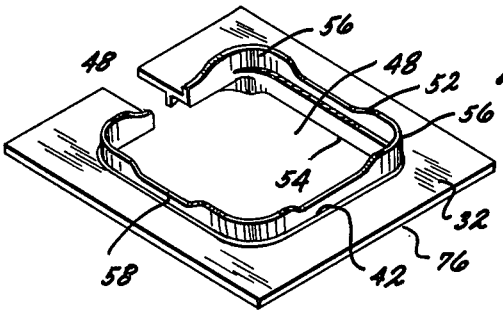
FIG. 16
FIG. 17
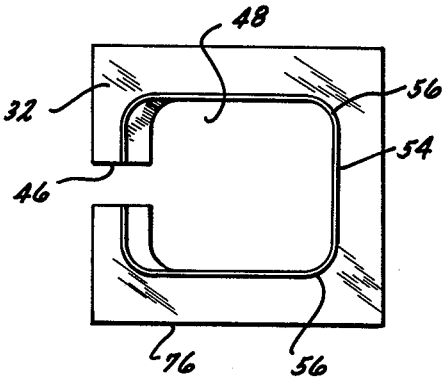
FIG. 18
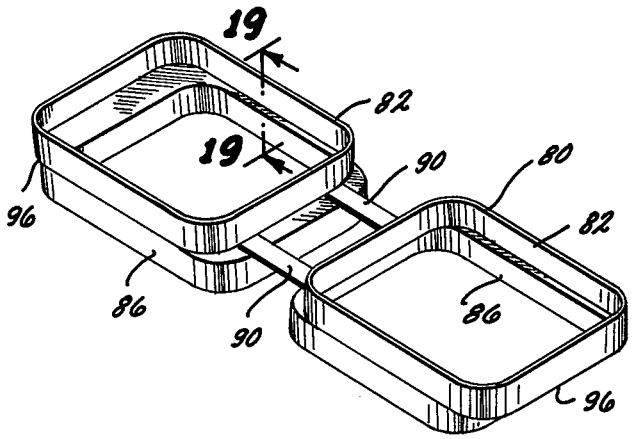
FIG. 19
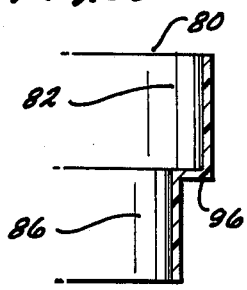
FIG. 20
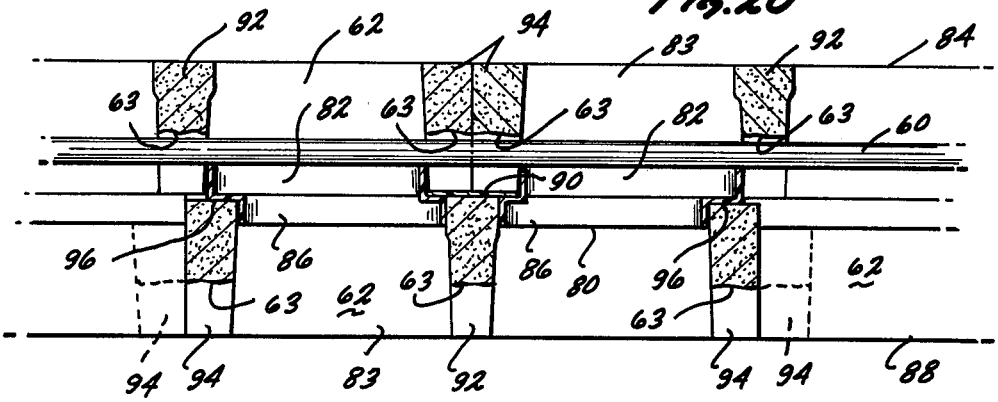

CEMENT BLOCK WALL

BRIEF SUMMARY OF THE INVENTION, BACKGROUND AND OBJECTIVES

My invention relates to a method of and means for constructing a cement block wall without mortar that is adaptable to use with standard precision blocks or the like.

It has been recognized that laying up a cement block wall with mortar in the conventional manner with mortar is expensive in terms of labor expenditure. For purposes of laying walls without mortar or for other purposes a number of non-conventional cement blocks have been proposed such as those set forth in U.S. Pat. Nos. 312,464, 1,809,508, 2,141,946 2,261,510, 2,963,828, 3,479,782, 3,783,566, and 3,936,987. Such proposals appear to have not been widely used. It is an objective of my invention to avoid the problems common to many of these prior proposals which include (a) lack of adaptability to cement blocks of standard manufacture so that special blocks would have to be manufactured and stocked, (b) difficulties in manufacturing such blocks with present equipment and/or at suitable production rates and at suitable other costs, and (c) fragile exposed special construction features so that the blocks could not be handled or stacked like standard blocks without undue breakage of those exposed parts. Whereas my means and method could be used with blocks specially manufactured for use with my invention or for other purposes, it has been a primary objective of my invention to adapt to blocks of standard manufacture, of which the standard precision block is an example. Another primary objective has been to provide a means and method that will be substantially less costly in terms of labor and materials than the conventional method of laying up cement block walls with mortar.

My invention will be best understood, together will additional objectives and advantages thereof, from the following description, read with reference to the drawings, in which:

FIG. 16 is a perspective view of the top of an interengaging member used with a half block.

FIG. 17 is a bottom view of the interengaging member shown in FIG. 16.

FIG. 18 is a perspective view of the top of a modified form of interengaging member.

FIG. 19 is an enlarged partial sectional view taken on line 19—19 of FIG. 18.

FIG. 20 is a side view, partly in section, of a member such as is shown in FIG. 18, the view showing installation in a wall.

Figure 1:
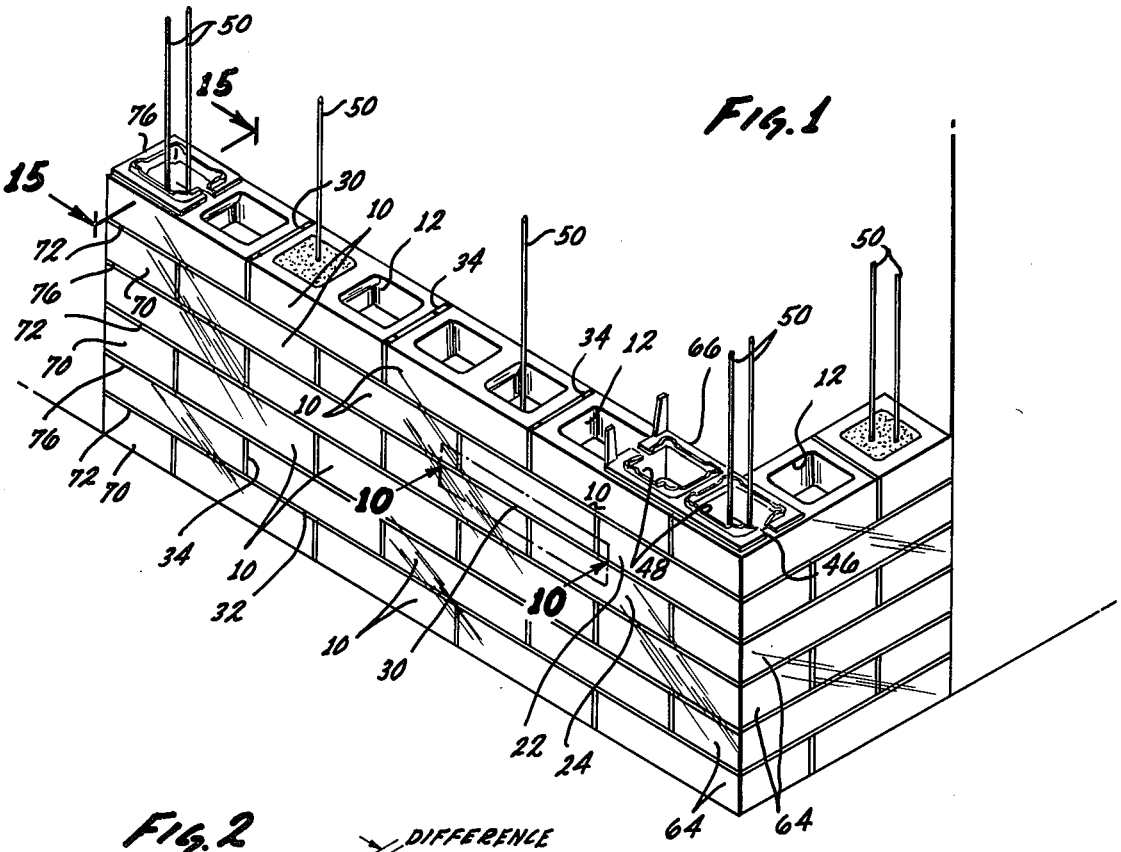
FIG. 1 is a perspective view of a cement block wall showing a specific embodiment of my new cement block wall and its method of construction.
Figure 2:
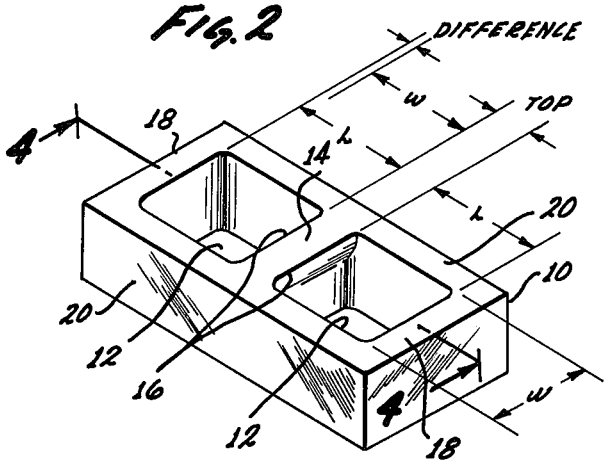
FIG. 2 is a perspective view of the top of a precision cement block of standard manufacture showing details of importance in describing the adaptability of my invention to such standard blocks.
Figure 3:
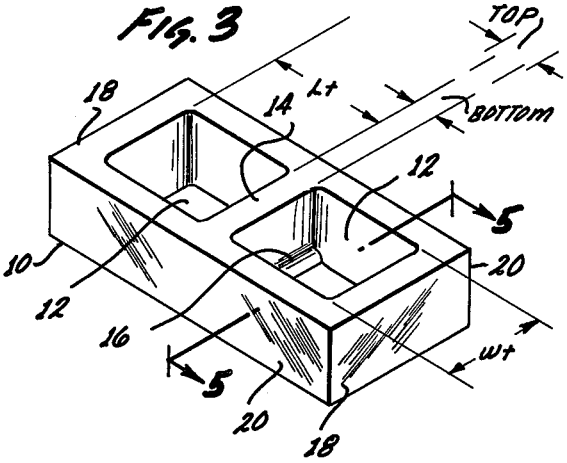
FIG. 3 is like FIG. 2 but views the bottom of such block.
Figure 4:
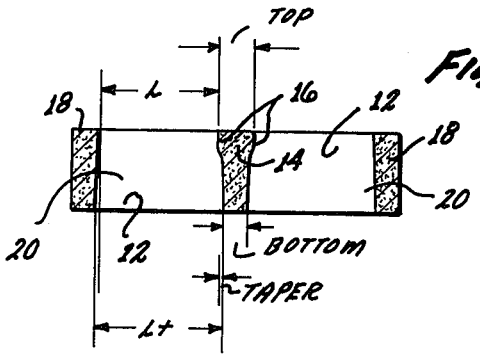
FIG. 4 is a sectional view taken on line 4—4 of FIG. 2.
Figure 5:
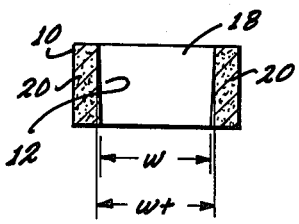
FIG. 5 is a sectional view taken on line 5—5 of FIG. 3.

As has been indicated, one objective of my invention was to provide means to erect a cement block wall without mortar and using standard blocks. There are several reasons for that objective. One reason is that sellers are relieved in block inventory, mold inventory, etc., if they do not have to manufacture special blocks in order for purchasers to be able to use the invention. Another reason is that problems of breakage may occur and production rates may suffer with special blocks, depending on their constructions, whereas standard blocks have acceptable breakage rates with standard stacking and handling practices and they are produced at economical production rates. This is not to state that my invention is not usable with blocks of some non-standard designs or with blocks that may be conceived that are especially adapted to use with my invention.

To understand my invention, it is important to understand some of the relevant structure of standard blocks.

One example of blocks in common use is the so-called precision block which is generally nominally 8 by 16 inches and of various heights. Actually the dimensions are short about ⅜ inch so as to lay in 16 inches increments including mortar, as 16 inches is a common increment in buildings. Dimensions also vary slightly due to wear of molds. Depending on various factors like location, type of construction involved, etc., other widths and lengths may be stocked by cement block sources (which are usually cement block manufacturers) or the plants may have molds available for production when orders are placed from time to time.

As indicated later in this description, bond beam blocks may be used in one version of the present invention, but bond beam blocks are of common manufacture. Another type of block common in at least some regions are stretcher blocks. Another standard variation is in face shell walls, e.g., normal thickness known as 2 hour blocks (2 hours for a fire to burn through face shells) versus 4 hour blocks (4 hours to burn through). Dimensions of interengaging members for precision blocks also will work with slump block of common manufacture, as the end walls have limited curvatures, although that is not true of slump blocks that I have manufactured with more end curvature or roll.

What I mean by the foregoing in distinguishing standard or common blocks from those uncommon will be understood by those skilled in the art, particularly as the discussion proceeds in discussing the details of my invention. I will now describe some of the characteristics of standard blocks which are being accommodated by my invention. The blocks variously shown in the series of FIGS. 1–17 may be taken to be precision blocks whereas the blocks variously shown in the series of FIG. 18–25 may be taken to be bond beam blocks which differ from precision blocks in having central grooves in end and center tie walls for the purpose of grouting in horizontal reinforcing rods.

FIGS. 2–6 show standard precision blocks 10 which, as indicated, are commonly nominally 8 × 16 inches by some height. According to usage in the art, FIG. 2 would be a top view and FIG. 3 would be a bottom view as that is the orientation in which they are normally handled, stacked and positioned in a wall, although when they are stripped from a mold in manufacture the so-called top is at the bottom and vice versa.

To facilitate stripping from the mold, mold cores are tapered as indicated by the change in dimension of cells 12 in FIGS. 2–8. The taper bottom to top or flare top to bottom is indicated by the difference between "L" and "L+" in length from top to bottom as viewed in FIGS. 2–3 and is indicated by the difference between "W" and "W+" from top to bottom as viewed in FIG. 2–3. Note in FIG. 2 that "L" is greater than "W" meaning that in plan view the cells 12 have the form generally of elongated rectangles. These are only generally rectangular as they have rounded corners. Taper also results in a narrower center walls at bottom than top, as illustrated by the change in dimensions shown in FIGS. 3 & 4 in the case of the center tie wall 14. Another reason for the change in dimension from "L+" to "L" is the presence of handholds 16 on the upper edges of center tie wall 14 at cells 12. These are formed to facilitate handling of blocks and act to reduce the length of the tops of cells 12. End tie walls 18 and face shell walls 20 likewise reduce in dimensions from top to bottom due to change in dimensions of cells 12.

The changes in dimensions from top to bottom is one reason that cells 12 are not coincident in plan view. There is additional reason for offset between the cells 12 of blocks of upper course 22 and lower course 24 in FIG. 10 and that is, due to half lapping of blocks, center tie wall 14 of upper course 22 is superposed to two end tie walls 18 of lower course 24 and end tie walls 18 of upper course 22 are superposed to center tie walls 14 of blocks of lower course 24. Considering the upper center tie wall 14 in FIG. 10, it is roughly half of the width of the two adjacent end tie walls 18 therebelow.

Because of changes in dimensions from top to bottom of cells 12 and because of off-set of cells in upper and lower course, the cells of upper and lower course blocks are not fully superimposed and, hence, any device to hold upper and lower course blocks together against dislodgement will have to compensate for such changes in dimension and for such offset in standard blocks walls. Such change of dimensions of cells and cell offsets may not be much noticed and may not be a problem generally in cement block walls, but I came to recognize these characteristics of cement block walls, which were difficult design limitations, when I started to think about devising a substitution for mortar in laying up cement block walls with a further design limitation of adaptability to walls made from standard cement blocks.

Figure 9:
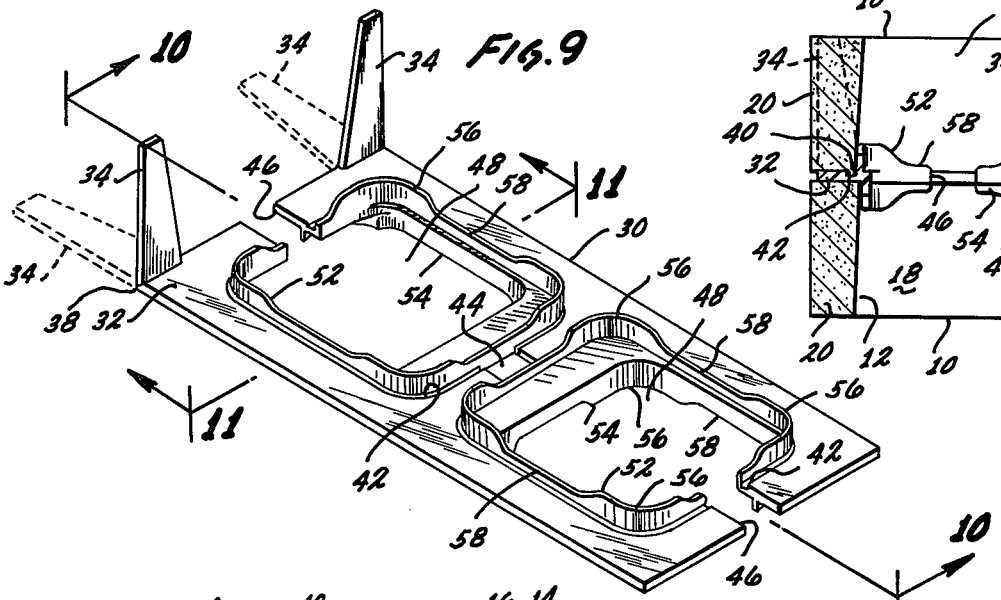
FIG. 9 is a perspective view of the top of a block interengaging member used with a full length block according to my invention. The dashed lines show the condition of the interengaging member before the end vertical flanges are folded up.
Figure 11:
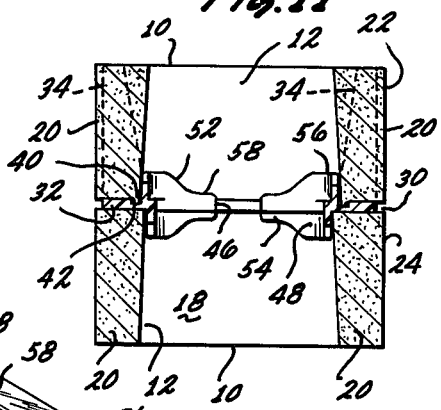
FIG. 11 is a sectional view taken in the orientation of line 11—11 of FIG. 9 but shown in conjunction with cement blocks as it would appear in a wall.

The block interengaging member 30 shown in FIG. 9 meets those design limitations. As will appear from following discussion, the structure of member 30 has to be changed at wall corners and has to be associated with modified members at wall ends because of the use of half blocks at wall ends, but partly the same structure is utilized in those modifications.

Part of the concept of interengaging member 30 is to substitute a thickness of plastic or other material for the normal horizontal and vertical motar joints between blocks and block courses. As such mortar is roughly ⅜ inch, the same dimension would be a suitable general thickness in order to maintain normal building increments, i.e., 16 inches in laying standard blocks 10, although other thicknesses could be used.

Member 30 could be made of plastic (with or without fiber reinforcement) or other material, such as pressed wood. Selection of material depends on various factors, One is economy. It is desirable there be some give to flanges engaging cells 12 to accommodate some irregularities in cells, so selection of material of some flexibility would be desirable. Some surface irregularities occur due to use of cement as a material to mold blocks 10. Fire resistance would not be a problem in some usages, such as cement block fences, but selection of a material meeting fire resistance standards (and avoidance of giving off toxic fumes at elevated temperatures) would be necessary in buildings. Fire resistance standards may vary from jurisdiction to jurisdiction and may also vary according to type of building. Filling certain plastics with asbestos fibers or the like may be one means of meeting fire resistance standards. From my contacts with persons skilled in the art of plastic materials and the like, it appears it will not be difficult to select appropriate materials meeting requirements of economy, structural properties, fire resistance, etc. It is deemed unnecessary to specify materials for construction of interengaging members 30 in the description, as those skilled in the art of plastic fabrication and the like will be able to make suitable selections without guidance from the present disclosure. The same is true of the modified form of invention shown in FIG. 18 and associated figures, although an interengaging member, made at least partly of metal, for example, might have better application in that modified structure than with interengaging member 30. As the interengaging members also can have a function, at least in some building applications, of sealing the area between superposed upper to lower cells against grout leakage when reinforcing bars are grouted in place therein, adjustment of tolerances or selections of materials may reflect the requirement of sealing. However, any sealing standard may be a loose one, i.e., to avoid substantial leakage rather than to avoid any leakage. The standard certainly would not be one of an air tight or even a liquid tight seal.

Interengaging member 30 has a horizontal portion 32 and upstanding vertical flanges 34 at one end of horizontal portion 32. Horizontal portion 32 and vertical flanges 34 space apart courses of blocks and blocks within a course to provide generally the same appearance as mortar joints. They extend nearly to the vertical side surface of the wall (adjacent to the outer surfaces of face shell walls 20). They may be recessed slightly as mortar is often recessed slightly from the plane of face shell walls 20 in common masonry practice.

Figure 26:
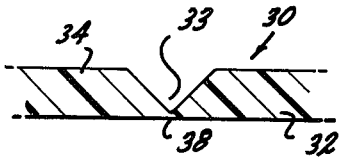
FIG. 26 is a partial, enlarged side view showing the hinged joinder of vertical and horizontal components of the interengaging member seen in FIG. 9.
Figure 8:
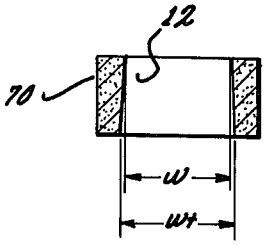
FIG. 8 is a sectional view taken on line 8—8 of FIG. 7.

As illustrated in FIG. 26 and in dashed lines in FIG. 9, it may be preferable in manufacture, storage, shipment, etc., to produce interengaging member with portion 32 and flanges 34 coplanar and to erect flanges 34 in the process of laying blocks. This is accomplished by providing a V-groove 36 between portions 32, 34, leaving a web 38 therebetween of perhaps 0.030 inch thickness, as a "hinge" in bending portion 34 to vertical disposition during wall construction.

Figure 6:
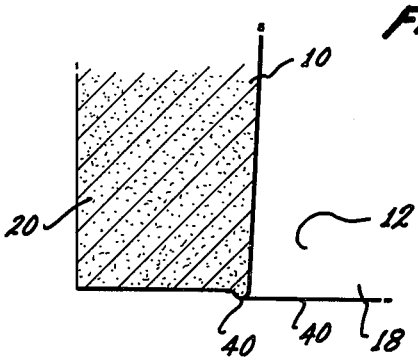
FIG. 6 is an enlarged partial sectional view of a block showing the feather that is often formed at the bottom of the block (the top of the block when it is being formed, as it clears the mold in manufacture).
Figure 7:
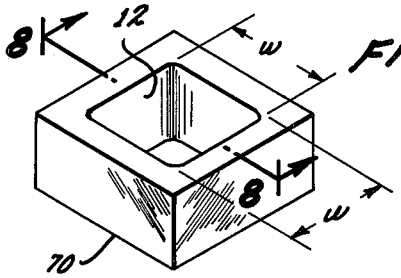
FIG. 7 is a perspective view of the top of a half block of standard manufacture.

As illustrated in FIG. 6, the lower cell edges may have slight feathers 40 depending therefrom. As before indicated, what is the bottom of the block during later usage is the top of the block as it is stripped from the mold, and the feathers 40 result from such factors as wear of mold parts with time and additional clearance between mold cores and stripper shoes at the bottom of the mold. To accommodate feathers 40, I provide grooves 42 on the upper face of horizontal portion 32 to receive these feathers. A groove 42 1/16 inch deep and 3/16 inch wide is suitable, which is situated adjacent to the flanges that are inserted in the lower ends of the cells 12 to the superposed block 10.

A central recess 44 is provided on the upper surface of horizontal portion 32 to accommodate roughness that often occurs in the center of the bottom (top as molded) of the center tie wall 14 due to cement tending to adhere to the core bar (the bar holding the mold cores together).

The vertical flange means 34 is centrally divided into two portions on either side and the ends of horizontal portion 32 has slots 46 to the paired openings 48 so that interengaging member 30 can be readily installed on a wall in which some vertical reinforcing rods 50 have already been grouted in place in block courses already laid, as illustrated in FIG. 1. If flange 34 were not divided and if slots 46 were not provided, openings 48 of interengaging member 30 would have to be threaded from the top of any rods 50 in place in the wall, which would be inconvenient.

To adequately orient and to hold blocks 10 in place in a wall against particularly lateral dislodgement, interengaging member 30 would have to engage walls of upper and lower cells 12 at least at points spaced longitudinally and laterally thereof. In order to accomplish this orientation and securement and also to provide an adequate sealment against grout leakage from between the adjacent ends of upper and lower course cells 12, I prefer to secure these ends with full upper flanges 52 and full lower flanges 54. In plan and bottom views these flanges 52, 54, like the plan views of cells 12, have the general forms of elongated rectangles (with rounded corners) and they fully fit and engage (within reasonable tolerances) the lower cell walls of the blocks of upper course 22 and the upper cell walls of the blocks of lower course 24. As previously indicated, it is preferred to form block engaging members 30 of material of some flexibility to provide some give in fitting flanges 52, 54 within the cells, and as previously indicated relative to providing a grout seal at this point, the fit does not have to be close and even enough to provide a watertight seal.

Figure 24:
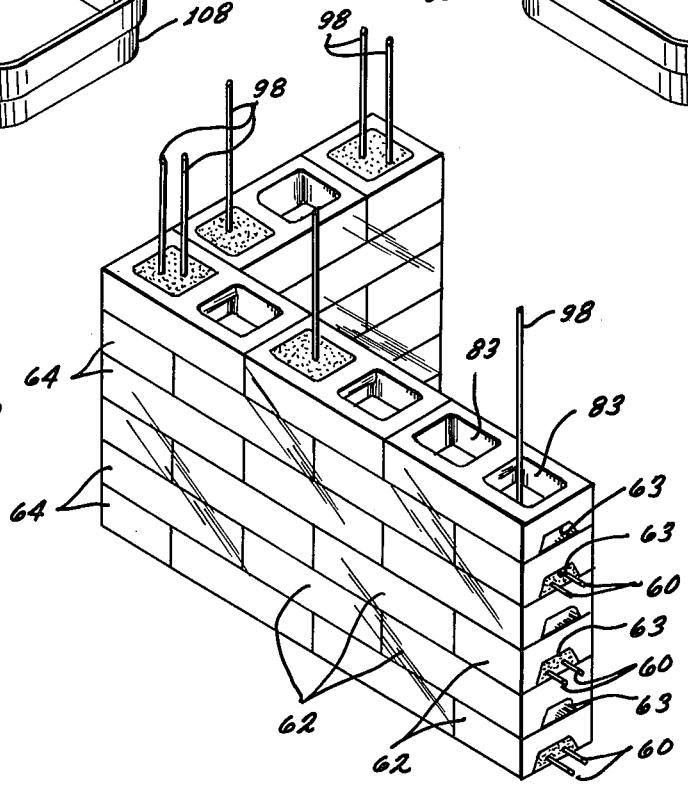
FIG. 24 is a view like FIG. 1 but shows construction of a wall with the modified form of the invention shown in FIGS. 18 - 23 in which blocks are abutted without spacing therebetween. Bond beam blocks are shown although commonly the exposed end tie wall in a bond beam block wall will be grooved.

Flanges 52, 54 preferably have extra body at the corners 56 as these understandably have to be particularly strong. This extra body can be provided by thickening but I show it being accomplished by extra height. The remainders or centers 58 of flanges 52, 54 could be of the same height except for the consideration of material savings were it not for the need on certain courses to grout in horizontal reinforcing rods 60 and to use bond beam blocks. (Such rods 60 and bond beam blocks 62 with central grooves 63 in their center and end tie walls are shown in FIG. 24 in connection with a modified form of invention). The shorter central flange portions 58 prevent unduly blocking grooves 63, i.e., provide enough room relative to the outlines of grooves 63 to pass horizontal rods 60.

Due to the taper of cells walls ("W", "W+", "L", "L+" in FIGS. 2–8) and due to the offset of upper and lower cells in courses 22, 24 as previously discussed, flanges 52 can not be fully superimposed to flanges 54 and it was a difficult design problem to accommodate inability to superpose block engaging means. It will be seen, in views such as FIGS. 11 and 15, that upper flanges 52 are most widely spaced than lower flanges 54.

Figure 10:
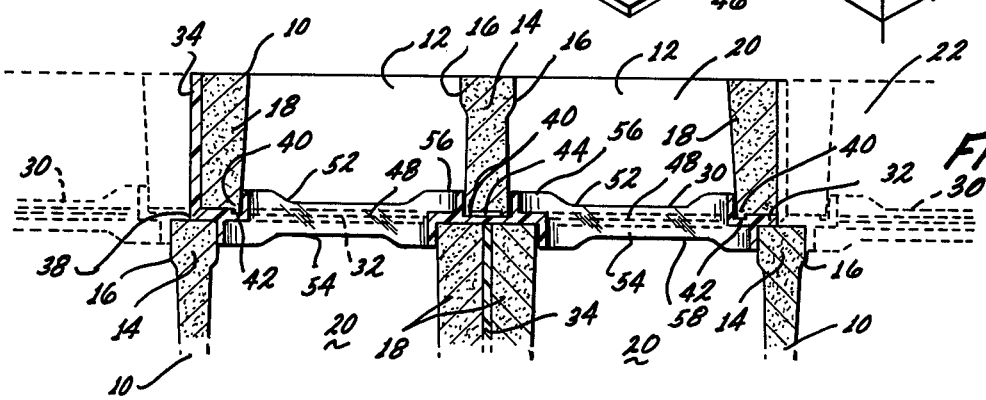
FIG. 10 is a partial sectional view of blocks and interposed member in the orientation of line 10—10 of FIG. 9 and taken as indicated by 10—10 in FIG. 1.
Figure 12:
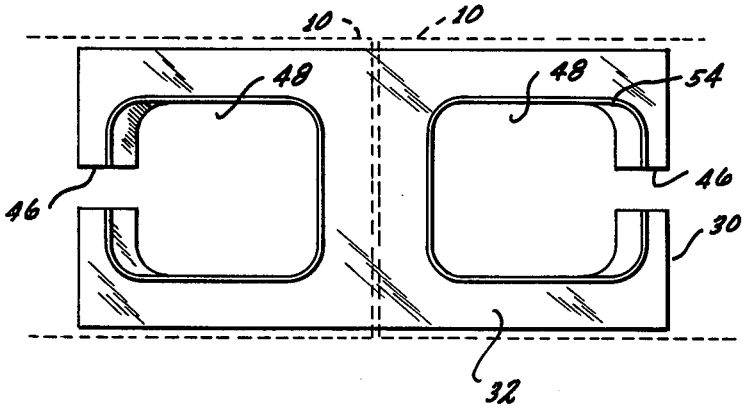
FIG. 12 is a bottom view of the interengaging member shown in FIG. 9, the view also indicating in dashed lines orientation relative to adjacent cement blocks.
Figure 27:
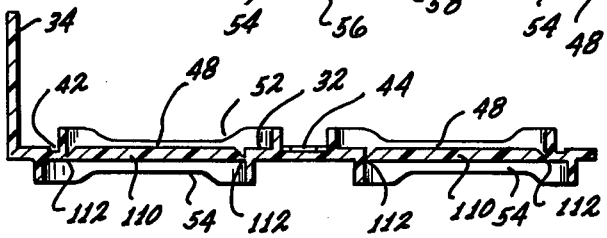
FIG. 27 is a side sectional view of the interengaging member shown in FIG. 9 but with removable knockout members bridging the openings therein.

Referring to side views such as FIGS. 10 and 27 (and as variously also apparent from other views such as FIG. 9), upper flanges 52 are not superposed to lower flanges 54 lengthwise of the blocks not only due to cell tapers and beacuse of handholds 16 but also because upper flanges 52 only accommodate a center tie wall 14 between them whereas lower flanges 54 accommodate two end tie walls 18 and vertical flanges 34 therebetween.

Figure 13:
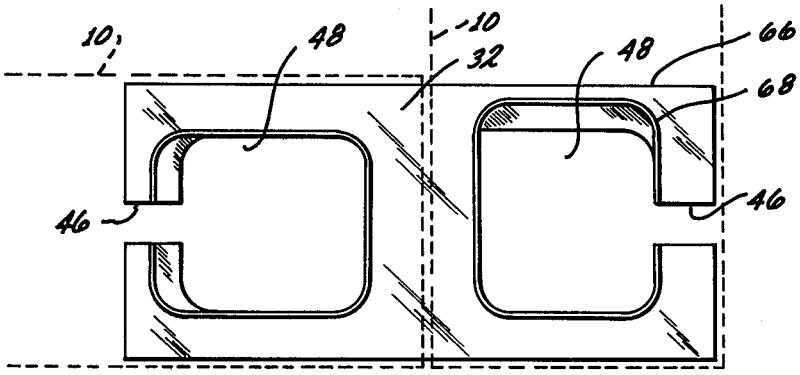
FIG. 13 is a bottom view like FIG. 12 but shows a modified interengaging member adapted to be used at wall corners.

Blocks 64 at corners of the wall (see FIG. 1) half lap at right angles to each other. This means one superposed cell is elongated at right angles to another and the normal interengaging members 30 will not accommodate corner installations. Special interengaging members 66 (right or left handed according to which way the corner extends) have to be provided, as illustrated in FIGS. 1 and 13. Block interengaging members 66 are like members 30 in most respects but lower flanges 68 instead of being elongated lengthwise of the blocks are elongated laterally of the associated upper block 64, as shown in FIG. 13. It could be said that block interengaging members 30, 66 are associated with upper course blocks and interengaging member 66 does not have a problem in engaging with the block thereabove in the same manner as interengaging member 30. It is the block therebelow it must adapt to and that is why the lower flange 68 extends to the side and is actually somewhat offcenter laterally of the block as indicated in FIG. 13.

Figure 14:
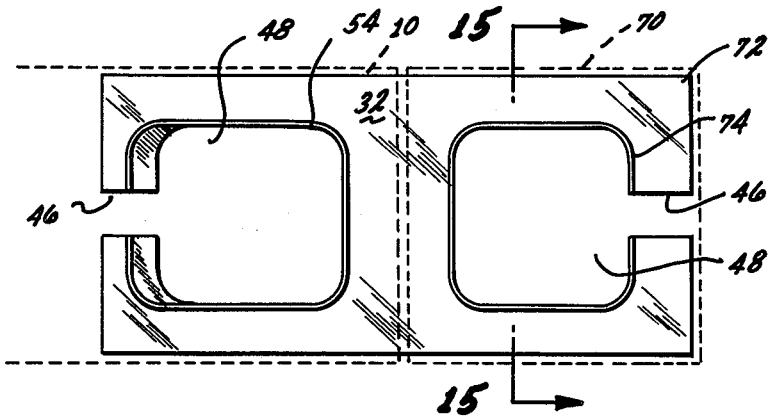
FIG. 14 is a bottom view like FIG. 12 but shows a modified interengaging member adapted to be used when one adjacent block is a half block.
Figure 15:
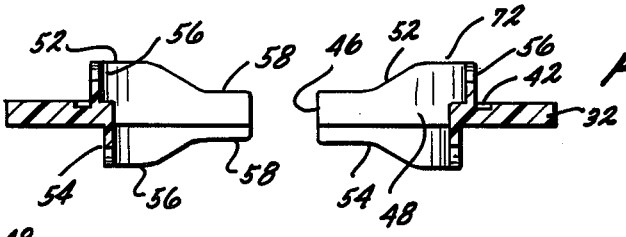
FIG. 15 is a sectional view of an interengaging member in the sense of line 15—15 of FIG. 1, and in the sense of line 15—15 of FIG. 14 only inverted.

Another special problem is at wall ends. The designer or builder often arranges for such wall ends (such as end of a fence, window opening or door opening) to end on a vertical line representing full block ends on every other course with half blocks therebetween, as indicated in FIG. 1. If wall ends are otherwise provided (than full and half block endings) such as requiring cutting of blocks, block interengaging members can be adapted as by cutting. A half block does not have a handhold. FIG. 14 shows a special block interengaging member 72 having a lower flange 74 adapted to engage in the upper cell walls of a half block 70. FIGS. 16 and 17 show a special block interengaging member 76 with upper flanges 52 fitting in the lower cell walls of a half block 70 and with lower flanges 54 fitting in the upper cell walls of a full length block.

Preservation of spacing of block courses and of blocks within a course to have the appearance of mortar joints does not always have to be required, i.e., in the case of fence or other walls that are going to be plastered or in other cases where a mortar joint appearance is deemed unnecessary. FIGS. 18–25 show a modified form of invention in which not only is mortar not used but also block courses and blocks within a course are directly abutted. The block interengaging members 80 have considerable similarity to block interengaging members 30 except for omission of horizontal portions 32 and vertical flanges 34, with certain exceptions. More specifically, upper flanges 82 engaging with the cells 83 of the blocks 62 of upper course 84 and lower flanges 86 engaging with the cells 83 of the blocks 62 of lower course 88 are generally like upper flanges 52 and lower flanges 54 of interengaging members 30, i.e., they have the form of elongated rectangles with rounded corners in plan and bottom views. Thus, they have the same functions of orienting adjacent blocks, holding them against particularly lateral dislodgement, and sealing the edges of adjacent cells against leakage of grout outwardly to the side surface of the face shell walls.

Ties or connecting members 90 are used to pair two sets of upper and lower flanges 82, 86. One reason for ties 90 is to prevent the two sides of the flanges it connects from falling down in cells 83. Referring to FIG. 20, it will be seen that, in the absence of ties 90, superposed flanges 86, 82 would not be supported on center tie wall 92 as the top of center tie wall 92 is narrower than the two end tie walls 94 superposed thereto. This is not a problem at the other ends as the upper center tie wall is superposed to two end tie walls 94 of greater combined widths, whereby there is an offset horizontal wall 96 on member 80 that rests on a lower end tie wall 94. The same problem does not occur with block interengaging members 30 because then flanges 52, 54 are supported by horizontal portions 32. As before indicated, interengaging members 30 can be said to be associated with an upper course block 10 as its upper flanges 52 fit in the cells of the same block 10, but interengaging members 80 can be said to be associated with a lower course block as ties 90 fit on top of a center tie wall 92 of a lower block with paired lower flanges 86 fitting in the cells 83 of the same lower course block 62.

Note in FIG. 24 that courses of blocks 62 and blocks 62 within a course fully abut. Bond beam blocks 62 (or other blocks having at least some grooving at 63 in center and end tie walls) are used in the FIG. 24 wall to leave room for connecting means 90. If regular precision blocks 10 were used as shown in FIG. 1 and 10, superposed end tie walls 18 could not sit down on the top of center tie wall 14 therebelow. As before indicated, bond beam blocks 62 have central grooves 63 in the bottoms of center tie walls 92 and end tie walls 94, which will avoid interference with ties 90. Normally, bond beam blocks are used to provide room for grouting in of horizontal reinforcing rods 60, but in the use of interengaging members 80, bond beam blocks 62 will be used even in cases where no rods 60 are present between courses. FIG. 24 was drafted for purposes of illustrating the invention with grooves 63 at the end of the wall but, in common practice in bond beam walls, grooves 63 are present in all end and center tie walls except at the end of a wall where full walls are present. Usually, blocks for ends of walls with grooves 63 in all walls but the exposed walls are provided by taking regular blocks 10 and making a groove by hand tools in the center tie wall and the inner end tie wall. Of course the wall of FIG. 24 can also have vertical reinforcing rods 98 grouted in place.

It might be noted in both forms of the invention that one saving of time over the use of mortar, other than the general avoidance of making horizontal and vertical mortar joints, is the avoidance of problems in making clean vertical channels in the block cells to grout in particularly vertical reinforcing rods. As the grouted in rods are responsible for most of the strength of the block wall, at least some jurisdictions require removal of all debris (i.e., mortar falling down) from the vertical channel (and bottom blocks have cleanout openings for manual cleanout) and inspect against excessive mortar extrusion horizontally at the junction of superposed cell walls. In both cases, the objective is to have as good a vertical column formed by the reinforcing rods and the grout used to grout in those rods as is reasonably feasible. With the use of interengaging members 30 and 80, these problems with mortar are avoided.

Figure 21:
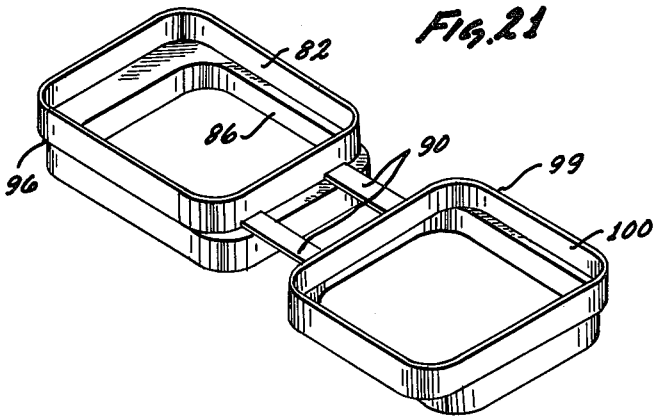
FIG. 21 is similar to FIG. 18 but shows a modification for use at the corner of a wall.
Figure 22:
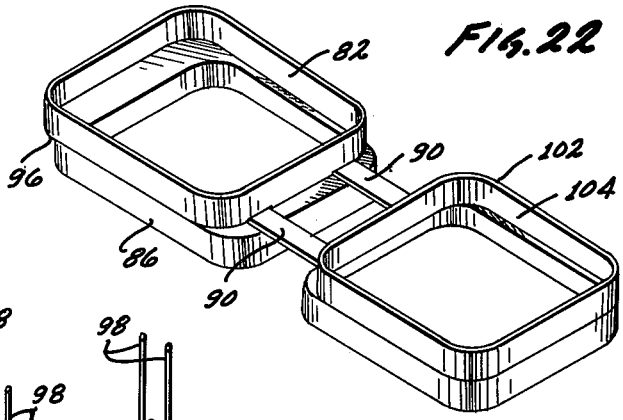
FIG. 22 is similar to FIG. 18 but shows a modification for use in conjunction with a half block.
Figure 23:
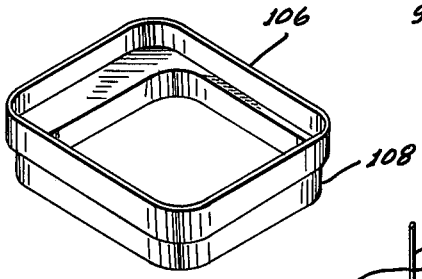
FIG. 23 is similar to FIG. 18 but shows a modification for use in conjunction with a half block.

FIG. 21 is comparable to FIG. 13, FIG. 22 is comparable to FIG. 14, and FIG. 23 is comparable to FIGS. 16 and 17 in being involved with corner and end wall installations and in having similar approaches to the design problems involved.

In FIG. 21, interengaging member 99 has a right hand upper flange 100 laterally elongated (and is somewhat offcenter) to engage in the lower cell wall of a superposed block extending at right angles at a wall corner.

In FIG. 22, interengaging member 102 has an upper flange 104 (right hand of figure) adapted to fit in the lower cell wall of a superposed half block at a wall end.

In FIG. 23, interengaging member 106 has a lower flange 108 adapted to fit in the upper cell wall of a half block at a wall end.

Like with interengaging member 30, interengaging member 80 has longitudinal and lateral spacing of upper and lower flange walls to accommodate the taper of block cells, to accommodate the presence of handholds, and to accommodate the different spacings in cells depending on whether they are separated by a single center tie wall 92 or two end tie walls 94. Flanges 82, 86 can not be simply superimposed and can not be of the same size.

Figure 25:
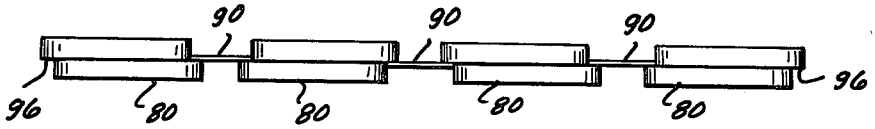
FIG. 25 is a side view showing interengaging members like those illustrated in FIG. 18 but with a series of four units secured together.

In FIG. 25 I show four sets of upper and lower flanges connected by ties 90 to indicate the invention is not limited to sets of two but instead may be of any suitable number. The concept is that the workman may lay down members 80 for a considerable length of wall in one operation and then set blocks thereon in a second operation.

In FIG. 27, I show knockouts 110 in block openings 48. When in the specification and claims I described openings in interengaging members 30 or 80 there usually will be vacant spaces but I don't wish to exclude the possibility of knockouts 110 being installed therein, which could be advantageous in grouting in horizontal reinforcing rods thereabove or for some other special building purpose. Knockouts 110 usually will be molded from the same material as the rest of the members 30 or 80 and will be connected to adjacent flanges by grooves producing reduced thickness webs 112 so as to be readily removed by striking the same. There would be other ways to weaken the joinder between knockout 110 and adjacent flanged portions or the whole knockout could be formed of thin material. Commonly, however, knockouts probably won't be used except for special purposes because they would make debris at the bottom of vertical columns of cells that would need to be removed before grouting in vertical steel.

The construction of cement block walls according to my invention appears to have been completely discussed in the course of the preceeding description. Courses of blocks are laid up without mortar using preformed interengaging members 30 or interengaging members 80. Generally (but not exactly) superposed cells are engaged to orient blocks, to prevent block dislodgement, and to seal against grout leakage at the adjacent boundaries of superposed cells. My tests with prototypes of the invention indicate very large labor savings with my invention.

Having thus described my invention, I do not wish to be understood as limiting myself to the exact details of construction shown but instead wish also to cover modifications thereof that will occur to those skilled in the art upon learning of my invention and which properly are within the scope of my invention.

I claim:

1. The improvement in a wall, comprising:

(a) said wall being formed by a multiplicity of cement blocks each having a pair of cells separated by a center tie wall, oppositely bounded by end tie walls, and having face shell side walls, the cell tapering from bottom to top and having handholds at the upper inner edges of said center tie wall, said blocks being laid in lower and upper courses and in end-to-end series in each course, each block of an upper course having each half resting on a different lower course block, (b) interposed members preformed independently of said wall and installed separating courses of blocks and separating adjacent blocks in each course, there being not mortar between courses of blocks and between adjacent blocks in each course, (c) each interposed member having a horizontal sheet-like portion and having integral therewith a vertical flange and each interposed member being associated with one upper course block with said horizontal portion extending substantially from end-to-end thereof and with said vertical flange connected to one end of said horizontal portion and lapping one end of the associated upper course block, (d) said vertical flange including portions adjacent to the vertical outer surfaces of face shell walls of the associated block thereby having an appearance like a vertical mortar joint, and said horizontal portion extending to a location adjacent to the vertical outer surfaces of face shell walls of the associated block thereby having an appearance like a horizontal mortar joint, (e) said horizontal portion having interengaging means to orient upper course blocks relative to lower course blocks and to secure upper course blocks from lateral shifting relative to lower course blocks, said interengaging means of each horizontal portion engaging in the lower cell walls of the upper course block with which it is associated and engaging in the upper cell walls of the two cells below the horizontal portion which are of two different lower course blocks, the interengaging means having sufficient contacts with the engaged cell walls to accurately orient and to adequately secure the blocks involved, and (f) said horizontal portions having openings therein extending throughout most of the areas common in plan view to cells of lower course blocks and to the cells of upper course blocks generally superposed thereto, and reinforcing rods in at least some of said generally vertically aligned cells of blocks in said wall and grout encasing said rods.

2. The subject matter of claim 1 in which said horizontal portion and said vertical flange of each interposed member are manufactured in coplanar position and are separated by a groove part-way through the interposed member reducing material thickness to achieve flexibility at said groove and said vertical flange hinging about said groove to achieve vertical orientation during installation in said wall.

3. The subject matter of claim 1 in which said interengaging means of the horizontal portion of each interposed member includes a pair of upper upstanding flanges each generally rectangular in plan view and closely fitting into the lower portions of the cells of the associated upper course blocks and includes a pair of lower depending flanges each generally rectangular in bottom view and closely fitting into the upper portion of a cell in one of the blocks in the next lower course, said upper and lower flanges not being completely superimposed due to the differences in dimensions in cell walls from bottom to top due to tapering thereof, due to the presence of said handholds, and due to the lapping of each upper course block half on each of two lower course blocks whereby said upper flanges are separated by a center tie wall whereas lower flanges are separated by two end tie walls, said openings including two in each interposed member, one being in the superimposed portions of each pair of upper and lower flanges.

4. The subject matter of claim 3 in which said interposed members are formed of plastic material.

5. The subject matter of claim 3 in which said flanges have more body in corners of their generally rectangular shapes thereby to securely engage cell corners.

6. The subject matter of claim 3 in which the vertical flange means of each interposed member is divided into two separated portions at each side thereof and the horizontal portion has a central end slot extending from each end to the adjacent opening whereby said interposed members may pass any vertical steel rods in place in cells in said wall when upper course blocks are being laid.

7. The subject matter of claim 3 in which there is a recess in the upper surface of the horizontal portion of each interposed member between the openings therein to accommodate roughness on the lower surfaces of upper course blocks caused by core bars.

8. The subject matter of claim 3 in which there are grooves in the upper surface of said horizontal portion about said upper upstanding flanges to accommodate any feathers at the margins of the cells of the associated upper course block.

9. The improvement in a wall, comprising:

(a) said wall being formed by a multiplicity of cement blocks each having a pair of cells separated by a center tie wall, oppositely bounded by end tie walls, and having face shell side walls, said blocks being laid in upper and lower courses and in end-to-end series in each course, each block of an upper course having each half resting on a different bottom course block, (b) interposed members preformed independently of said wall and installed separating courses of blocks and separating adjacent blocks in each course, there being no mortar between courses of blocks and between adjacent blocks in each course, (c) each interposed member having a horizontal sheet-like portion and having integral therewith a vertical flange and each interposed member being associated with one upper course block with said horizontal portion extending substantially from end-to-end thereof and with said vertical flange connected to one end of said horizontal portion and lapping one end of the associated upper course block, (d) said interposed members having openings therein extending throughout most of the areas common in plan view to cells of lower course blocks and to the cells of upper course blocks generally superposed thereto, and reinforcing rods in at least some of said generally vertically alinge cells of blocks in said wall and grout encasing said rods (e) said vertical flange including portions adjacent to the vertical outer surfaces of face shell walls of the associated upper course block thereby having an appearance like a vertical mortar joint, and said horizontal portion extending to a location adjacent to the vertical outer surfaces of face shell walls of the associated block thereby having an appearance like a horizontal mortar joint.

10. The subject matter of claim 9 in which said horizontal portion and said vertical flange of each interposed member are manufactured in coplanar position and are separated by a groove part-way through the interposed member reducing material thickness to achieve flexibility at said groove and said vertical flange hinging about said groove to achieve vertical orientation during installation in said wall.

11. The subject matter of claim 9 in which there is a recess in the upper surface of the horizontal portion of each interposed member extending between the openings therein to accommodate roughness on the lower surfaces of upper course blocks caused by core bars.

12. The subject matter of claim 9 in which the vertical flange means of each interposed member is divided into two separated portions at each side and the horizontal portion has a central end slot extending from each end to the adjacent opening whereby said interposed members may pass any vertical steel rods in place in cells in said wall when upper course blocks are being laid.

13. The subject matter of claim 9 in which said horizontal portion has grooves on its upper face about the margins of said openings to accommodate any feathers at the margins of the cells of the associated upper course block.

14. The subject matters of claim 9 in which said interposed member has knockouts in said openings which include sheet material bridging each opening and joined to the remainder of the associated interposed member by weakened portions whereby said knockouts can be readily broken off.

15. The improvement in a wall, comprising:

(a) said wall being formed primarily by a multiplicity of cement blocks each having a pair of cells separated by a center tie wall, oppositely bounded by end tie walls, and having face shell side walls, the cells tapering from bottom to top and having handholds at the upper inner edges of said center tie wall, said blocks being laid in lower and upper courses and in end-to-end series in each course, each block of an upper course having each half resting on a different bottom course block, (b) interengaging means preformed independently of said wall and installed to orient upper course blocks relative to lower course blocks and to secure upper course blocks from lateral shifting relative to lower course blocks, said interengaging means engaging in the lower walls of the upper course cells and engaging with the upper walls of lower course cells, the interengaging means having sufficient contacts with the engaged cell walls to accurately orient and to adequately secure the blocks involved against dislodgement, (c) said interengaging means having openings therein extending throughout most of the areas common in plan view to cells of lower course blocks and to the cells of upper course blocks generally superposed thereto, and reinforcing rods in at least some of said generally vertically aligned cells of blocks in said wall and grout encasing said rods (d) the interengaging means associated with each upper course block having a pair of upper engaging means for cells of upper course blocks which are differently located than lower engaging means for lower course blocks and are not fully superposed, said upper engaging means being more widely spaced laterally of said wall than said lower engaging means due to differences in dimensions in cell walls from bottom to top because of tapering thereto, and said upper engaging means being closer together for the cells of the associated upper course block than the associated lower engaging means due to the lapping of the associated upper course block half on each of two lower course blocks whereby said upper engaging means are separated by a center tie wall whereas lower flanges are separated by two end tie walls, and (e) said interengaging means including sealing means extending between the upper edges of each cell of a lower course block and the generally superimposed lower edges of a cell of an upper course block thereby sealing against grout leakage such as when reinforcing rods are grouted into cells in said wall, said sealing means closely and completely engaging the full upper edges of each cell of lower course blocks and closely and completely engaging the full lower edges of each cell of upper course blocks thereby making complete block seals against such grout leakage.

16. The subject matter of claim 15 in which said blocks of said courses abut and adjacent blocks abut and there is no mortar between courses of blocks and between adjacent blocks in each course.

17. The subject matter of claim 15 in which there are a series of interengaging means and there are tie means connecting together and accurately spacing said series of interengaging means in a strip whereby in laying an upper course of blocks said interengaging means first can be engaged with the cells of lower course blocks by laying down said strip thereby automatically locating said interengaging means when at least two interengaging means are accurately oriented relative to cells of said lower course blocks.

18. The subject matter of claim 15 in which there are knockouts in said openings in said interengaging means which include sheet material bridging each opening and joined to the remainder of said interengaging means by weakened portions whereby said knockouts can be readily broken off.

19. The subject matter of claim 15 in which said cement blocks are standard precision cement blocks.

20. The subject matter of claim 15 in which said interengaging means have the form of upper and lower elongated generally rectangular flanges, upper flanges extending into and closely fitting adjacent cell walls of upper course blocks and lower flanges extending into and closely fitting adjacent cell walls of lower course blocks, said blocks generally each having two cells having the shape in plan view generally of an elongated rectangle and said interengaging means being connected together in pairs to engage with two upper course block cells and two lower course block cells, said wall having a ninety degree corner whereby at said corner some cells have their elongated rectangular shapes oriented in a first direction and some cells have their elongated rectangular shapes oriented in a second direction ninety degrees to said first direction, and some of the pairs of interengaging means have one set of said rectangular flanges elongated in plan view in said first direction and the other set of said rectangular flanges elongated in plan view in said second direction.

21. The subject matter of claim 20 in which said wall has some half blocks therein and in addition to said pairs of interengaging means there being some single interengaging means to compensate for the lengths of said half blocks.

22. The subject matter of claim 15 in which each interengaging means includes an upstanding flange generally rectangular in plan view and closely fitting into the lower portion of a cell of an associated upper course block and includes a depending flange generally rectangular in bottom view and closely fitting into the upper portion of an associated lower course block, said upper and lower flanges not being completely superimposed due to differences in cell walls from bottom to top due to tapering thereof, due to the presence of said handholds, and due to the lapping of each upper course block, with cells separated by a center tie wall, half on each of two lower course blocks having adjacent cells separated by two end tie walls.

23. The subject matter of claim 22 in which said blocks of said courses abut and adjacent blocks abut and there is no mortar between courses of blocks and between adjacent blocks in each course.

24. The subject matter of claim 15 in which said blocks are bond beam blocks with the bottoms of center tie walls and end tie walls having central grooves and there are tie members connecting together said interengaging means in pairs, said tie members supporting the pair of interengaging means relative to the center tie wall of the associated lower course block, said tie members being disposed in central grooves of end tie walls of upper course blocks.

* * * * *